US006895939B2

(12) United States Patent
Gould et al.

(10) Patent No.: US 6,895,939 B2
(45) Date of Patent: May 24, 2005

(54) FUEL INJECTOR CLAMPING ASSEMBLY

(75) Inventors: DeForest C. Gould, Washington, IL (US); Werner H. Koeslin, Peoria, IL (US); Edwin H. Langewisch, Dunlap, IL (US); Judson R. Bruce, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/434,219

(22) Filed: May 9, 2003

(65) Prior Publication Data

US 2004/0118383 A1 Jun. 24, 2004

(51) Int. Cl.[7] ..... F02M 37/04
(52) U.S. Cl. ..... 123/470; 123/509
(58) Field of Search ..... 123/470, 495, 123/472, 509, 456

(56) References Cited

U.S. PATENT DOCUMENTS

| | | | | |
|---|---|---|---|---|
| 4,164,927 A | | 8/1979 | Congram et al. | |
| 4,206,725 A | | 6/1980 | Jenkel et al. | |
| 4,246,877 A | | 1/1981 | Kennedy | |
| 4,473,047 A | | 9/1984 | Jakuba et al. | |
| 4,527,738 A | | 7/1985 | Martin | |
| 4,901,700 A | | 2/1990 | Knight et al. | |
| 5,237,976 A | | 8/1993 | Lawrence et al. | |
| 5,255,650 A | * | 10/1993 | Faletti et al. | 123/322 |
| 5,325,834 A | | 7/1994 | Ballheimer et al. | |
| 5,499,612 A | | 3/1996 | Haughney et al. | |
| 5,609,134 A | * | 3/1997 | Schmidt et al. | 123/322 |
| 5,870,995 A | | 2/1999 | Stockner et al. | |
| 6,026,786 A | | 2/2000 | Groff et al. | |
| 6,098,903 A | | 8/2000 | Touvelle et al. | |
| 6,148,797 A | * | 11/2000 | Gmelin | 123/456 |
| 6,178,950 B1 | | 1/2001 | Stockner et al. | |
| 6,196,194 B1 | | 3/2001 | Mitchell | |
| 6,205,975 B1 | | 3/2001 | Ruedin et al. | |
| 6,276,339 B1 | * | 8/2001 | Shebert, Jr. et al. | 123/470 |

* cited by examiner

*Primary Examiner*—Weilun Lo
(74) *Attorney, Agent, or Firm*—Finnegan, Henderson, Farabow, Garrett & Dunner

(57) ABSTRACT

A clamping assembly for clamping a fuel injector into a fuel injector bore located in cylinder head of an engine includes a housing having a housing opening, connectors coupling the housing to the cylinder head, and a compression spring. The compression spring is located in the housing opening, operably coupled to a top of the fuel injector, and axially aligned with a longitudinal axis of the fuel injector.

18 Claims, 3 Drawing Sheets

FUEL INJECTOR CLAMPING ASSEMBLY

PRIORITY BENEFIT

This application claims the benefit of U.S. application Ser. No. 10/324,087, filed Dec. 20, 2002, (which has been converted to Provisional Application No. 60/453,702).

TECHNICAL FIELD

This invention relates generally to internal combustion engines, and more particularly to a fuel injector clamping assembly for an internal combustion engine.

BACKGROUND

Current engine designs emphasize compactness with the goal of achieving smaller size and lower weight. One drawback of this emphasis on engine compactness includes the difficulty associated with servicing an engine that has its valving, fuel systems and wiring very tightly packed under the valve cover. In particular, servicing a fuel injector of an engine in compact engine designs may be difficult due to problems accessing the components that secure the fuel injector in place. For example, the compactness of an engine may require the fuel injector clamp and fuel injector to be removed and installed simultaneously as one unit, or may require the removal of several other components of the engine in order to gain access to the injector clamp or the fuel injector itself.

In addition to the above stated accessibility problems, conventional injector clamping assemblies may also allow detrimental excess clamping loads to be applied to the fuel injector. Such detrimental excess loads could result from merely bolting down an injector clamp too tightly. Excess clamping loads applied to a fuel injector can distort the injector body which can cause seizure of the injector plunger or other close tolerance elements of the injector. Excess clamping loads may also prohibit the necessary expansion of the fuel injector due to combustion pressures and temperature variations.

One example of a conventional fuel injector clamping assembly is disclosed in U.S. Pat. No. 5,499,612 to Haughney et al. As illustrated in FIGS. 1–3 of Haughney et al., removal of the fuel injector from the cylinder head requires gaining access to an injector clamp fastener that is located in a narrow space between rocker arm members and located at a distance from the longitudinal axis of the fuel injector. In addition to gaining access to and disconnecting the injector clamp, removal of the fuel injector from the cylinder head also requires disconnecting a high pressure actuating fluid rail branch passage from the top of the fuel injector.

Haughney et al. rigidly clamps the fuel injector into the injector bore of the cylinder head by way of an injector clamp that is bolted to the cylinder head. If the injector clamp is bolted down too tightly to the cylinder head, detrimental clamping loads may be applied to the fuel injector.

The present invention provides a fuel injector clamping assembly that avoids some or all of the aforesaid shortcomings in the prior art.

SUMMARY OF THE INVENTION

In accordance with one aspect of the invention, a clamping assembly for clamping a fuel injector into a fuel injector bore located in cylinder head of an engine includes a housing having a housing opening, connectors coupling the housing to the cylinder head, and a compression spring. The compression spring is located in the housing opening, operably coupled to a top of the fuel injector, and axially aligned with a longitudinal axis of the fuel injector.

According to another aspect of the present invention, a method for clamping a fuel injector in a fuel injector bore located in a cylinder head of an engine includes coupling a housing to the cylinder head at least partially above the fuel injector, and operably coupling a compression spring to a top of the fuel injector, the compression spring located between the housing and the top of the fuel injector.

It is to be understood that both the foregoing general description and the following detailed description are exemplary and explanatory only and are not restrictive of the invention, as claimed.

BRIEF DESCRIPTION OF THE DRAWINGS

The accompanying drawing, which is incorporated in and constitutes a part of this specification, illustrates an exemplary embodiment of the invention, and together with the description, serves to explain the principles of the invention.

DETAILED DESCRIPTION

Reference will now be made in detail to exemplary embodiments of the invention, examples of which are illustrated in the accompanying drawings.

Figure 1:
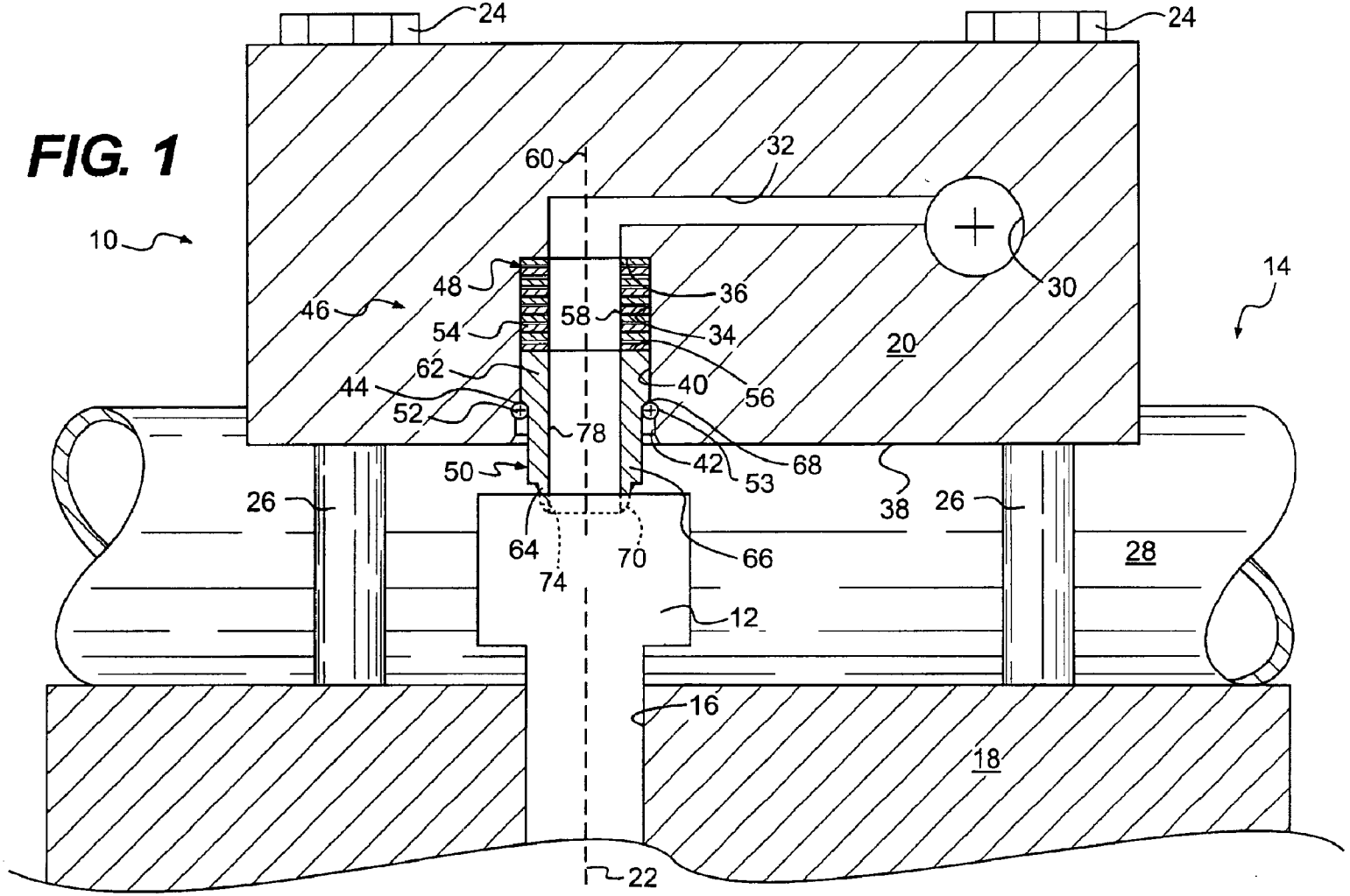
FIG. 1 is a partial cross-section and partial diagrammatic view of a fuel injector clamping assembly according to an exemplary embodiment of the present disclosure.

FIG. 1 illustrates a clamping assembly 10 for a hydraulically-actuated, electronically-controlled fuel injector 12 of an internal combustion engine 14. Fuel injector 12 may be received in an injector bore 16 provided in a cylinder head 18 of engine 14. Injector bore 16 may be sized to position a nozzle tip (not shown) of fuel injector 12 in a combustion chamber (not shown) of engine 14 to allow injection of fuel through the nozzle tip and into the combustion chamber.

A compression release brake housing 20 may be coupled to cylinder head 18 and located above fuel injector 12. The orientation "above the fuel injector" is measured relative to a longitudinal axis 22 of fuel injector 12. Brake housing 20 may be coupled to cylinder head 18 in any conventional manner, for example, by connectors such as plurality of bolts 24 extending through brake housing 20, through spacers 26, and into cylinder head 18. Alternatively, brake housing 20 may be secured to a high pressure actuating fluid rail 28 and/or one or more rocker arm stands (not shown) of engine 14. While not shown in FIG. 1, it is understood that engine 14 may include conventional mechanically or hydraulically actuated intake and exhaust valve components, including, for example, push rods, rocker arms, valve stems and valve stem bridges, and conventional compression release brake components. It is further understood that the present invention is not limited to one fuel injector of an engine, but may be applied to any number of fuel injectors.

In addition to the conventional components of a compression release brake assembly, brake housing 20 may include a series of actuating fluid passages 30, 32 that are fluidly coupled to high pressure actuating fluid rail 28. Actuating fluid passages 30, 32 of brake housing 20 may communicate with an opening 34 formed in brake housing 20. Opening 34 may extend from a distal end surface 36 interior of brake housing 20 to an outer surface 38 of brake housing 20 located opposite cylinder head 18. Opening 34 may include a generally cylindrical shaped distal wall portion 40 located distal of brake housing surface 38 and a generally cylindrical shaped proximal wall portion 42 located proximal to brake housing surface 38. Proximal wall portion 42 and distal wall portion 40 may be separated by a step 44 so that proximal wall portion 42 has a greater diameter than distal wall portion 40.

Still referring to FIG. 1, clamping assembly 10 may include an injector biasing assembly 46 including a biasing component 48, a coupling component 50, and a retaining component 52. Biasing component 48 may be formed of a compression spring defined by a plurality of stacked belleville washers 54 compressed so as to maintain a compression spring force. Alternatively, biasing component 48 may be formed of a single belleville washer or one or more of any other compression spring-type element, such as a wave washer, finger spring washer, curved spring washer, coil spring, or synthetic elastic element. Each of the above listed biasing components 48 may be broadly categorized as a component providing a spring force. Biasing component 48 may be positioned to abut distal end surface 36 of opening 34 and a distal end surface 56 of coupling component 50. Further, biasing component 48 may include an inner passage or bore 58 in fluid communication with actuating fluid passages 30, 32 formed in brake housing 20.

Coupling component 50 of injector biasing assembly 46 may be formed of a rigid material, such as aluminum, may include a generally cylindrical shape, and may extend from inside opening 34 in brake housing 20 to a location outside of brake housing 20. Coupling component 50 may be aligned with fuel injector 12 so that a longitudinal axis 60 of coupling component 50 substantially aligns with longitudinal axis 22 of fuel injector 12. Coupling component 50 may include a distal end portion 62 located distal to fuel injector 12, a proximal end portion 64 located proximal to fuel injector 12, and an intermediate portion 66 located between proximal end portion 64 and distal end portion 62. Distal end portion 62 may be separated from intermediate portion 66 by a step 68 so that distal end portion 62 forms a larger outer diameter than intermediate portion 66. Proximal end portion 64 may include a rounded tapering outer surface 70. Coupling component 50 may be formed as a sleeve element having an inner passage or bore 78 with a generally constant inner diameter. Inner passage 78 of coupling component 50 may be fluidly connected with inner passage 58 of biasing component 48.

Retaining component 52 may comprise a clip ring member located in a gap formed between a wall of opening 34 and coupling component 50. In particular, retaining component 52 may be partially located in a concavely shaped groove 53 formed in proximal wall portion 42 of opening 34 at or near step 44, and about intermediate portion 66 of coupling component 50 at or near step 68. Retaining component 52 may be formed of a toroidal steel ring with a circular cross section. Further, retaining component 52 may be sized to abut step 68 in coupling component 50 to retain the biasing component 48 and coupling component 50 in opening 34, while allowing a small amount of controlled preload on injector biasing assembly 46.

Figure 2:
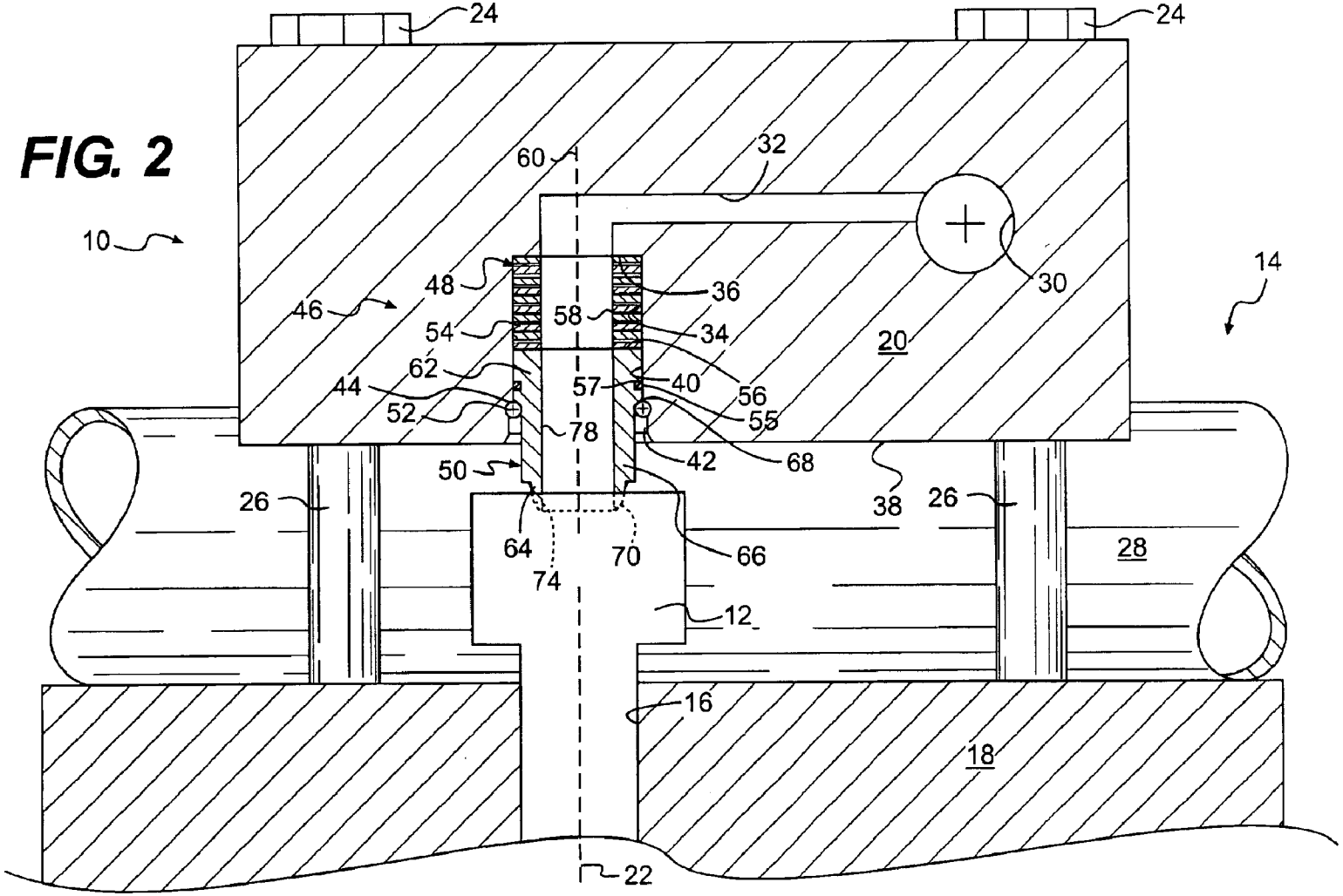
FIG. 2 is a partial cross-section and partial diagrammatic view of a fuel injector clamping assembly according to another exemplary embodiment of the present disclosure.

FIG. 2 illustrates the clamping assembly 10 illustrated in FIG. 1, but with the addition of a sealing component 55 located in a groove 57 formed in distal end 62 of coupling component 50. Sealing component 55 contacts distal wall portion 40 of opening 34 and coupling component 50 to form a fluid seal therebetween. Sealing component 55 may be formed of an O-ring of elastic material and sized to urge against distal wall portion 40 of opening 34 and coupling component 50.

Figure 3:
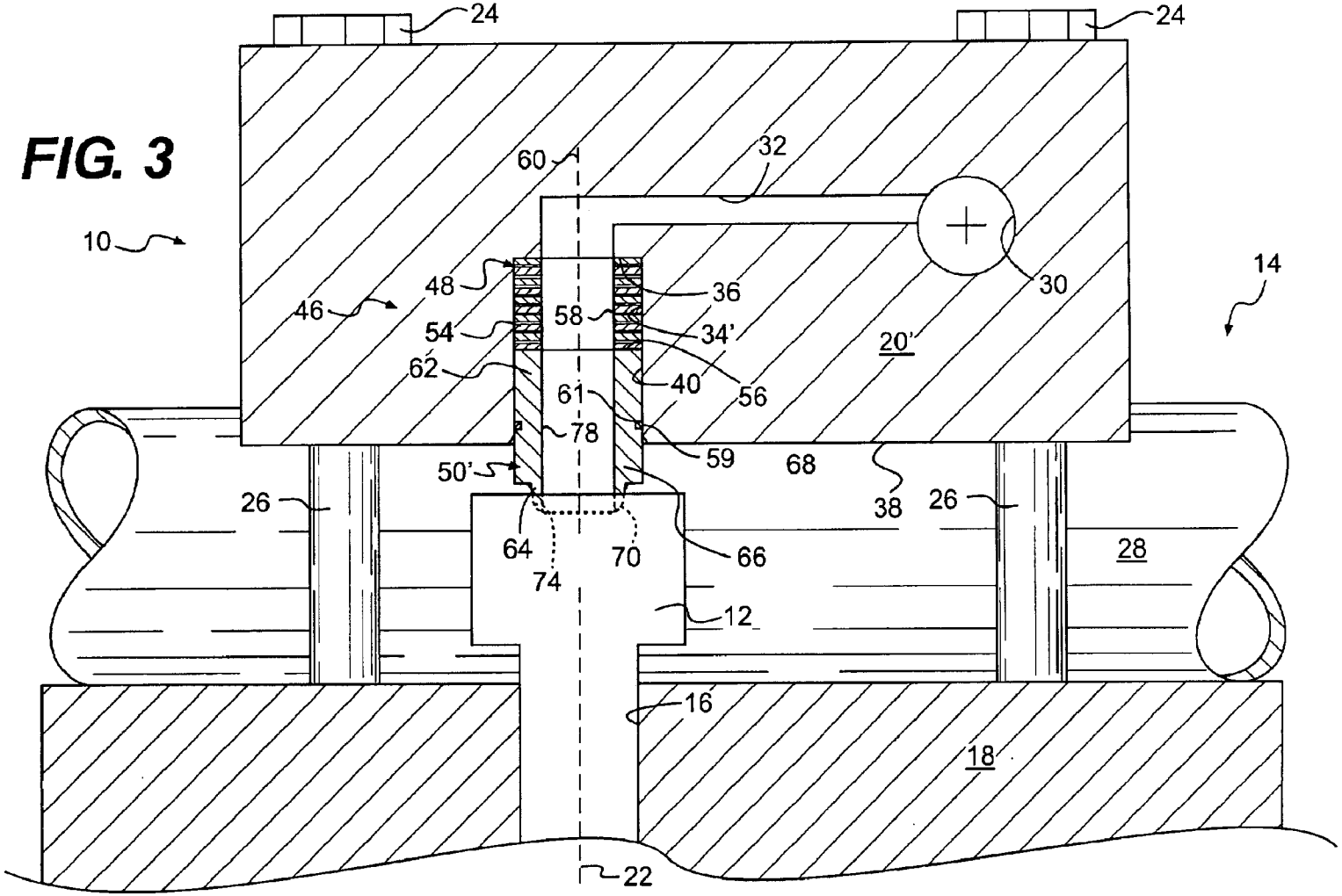
FIG. 3 is a partial cross-section and partial diagrammatic view of a fuel injector clamping assembly according to yet another exemplary embodiment of the present disclosure.

FIG. 3 illustrates an alternative arrangement for clamping assembly 10. In this arrangement, a coupling component 50' and an opening 34' in brake housing 20' may be formed of a single diameter, rather than with the steps 44 and 68 detailed above in the arrangement of FIGS. 1 and 2. A retaining component 59 may be located in a groove 61 formed in coupling component 50'. Retaining component 59 may be an O-ring formed of elastic material and sized to urge against wall portion 40' of opening 34' and coupling component 50' to retain biasing assembly 48 and coupling component 50' within opening 34'.

Finally, fuel injector 12 may include a top mounted actuating fluid inlet 74 shaped to sealingly receive rounded tapering outer surface 70 of proximal end portion 64 of coupling component 50. Accordingly, passages 30, 32 of brake housing 20 fluidly connect to actuating fluid inlet 74 of fuel injector 12 through inner passages 58 and 78 formed in biasing component 48 and coupling component 50, respectfully. Actuating fluid inlet 74 of fuel injector 12 may fluidly communicate with an actuating fluid valve (not shown) of fuel injector 12.

Industrial Applicability

Clamping assembly 10 serves to resiliently yet rigidly secure fuel injector into correct position within injector bore 16 of cylinder head 18. Further, in accordance with an exemplary embodiment of the present invention, clamping assembly may also provide fluid passages for supplying actuating fluid from high pressure actuating fluid rail 28 to fuel injector 12.

As noted above, clamping assembly 10 may include injector biasing assembly 46, brake housing 20, bolt fasteners 24 and spacers 26. Accordingly, fuel injector 12 is secured within injector bore 16 by aligning injector biasing assembly 46 with actuating fluid inlet 74 and securing brake housing 20 to cylinder head 18. Rounded tapering outer surface 70 of proximal end portion 64 of coupling component 50 acts to center coupling component 50 within actuating fluid inlet 74 of fuel injector 12 and thus reduces the occurrence of detrimental eccentric loading.

It is appreciated that the components of clamping assembly 10 are sized and aligned with fuel injector 12 so that fuel injector 12 is not distorted upon the securing of clamping assembly 10 to cylinder head 18. Further, while the components of clamping assembly 10 are sized to ensure that fuel injector is secured to cylinder head 18, biasing component 48 adds a spring force or resiliency to the coupling that limits load increases on fuel injector 12 resulting from cylinder head 18 deflections caused by thermal expansion and/or cylinder pressure. Thus, as clamping assembly 10 is secured to cylinder head 18 (or to other components of engine 14), the load on fuel injector 12 is controlled. The load on the injector is increased to a desired value and, as the engine components expand and contract due to engine operation, the load on fuel injector 12 varies minimally due to the spring effect provided by biasing component 48.

Access to fuel injector 12 is achieved by disconnecting brake housing 20 from cylinder head 18 (or from any other component to which it is coupled). Once brake housing 20 is removed, and the injector biasing assembly 46 with it, fuel injector may be lifted from injector bore 16.

As noted above, brake housing 20 and injector biasing assembly 46 may provide passages 30, 32, 58 and 78 for communicating high pressure actuating fluid from high pressure actuating fluid rail 28 to fuel injector 12. In particular, high pressure actuating fluid may flow from high pressure actuating fluid rail 28 through passages 30, 32 of brake housing 20, through inner passage 58 of biasing component 48, through inner passage 78 of coupling component 50 and into actuating fluid inlet 74 of fuel injector 12. Actuating fluid may then be selectively applied to an intensifier piston (not shown) of fuel injector 12 to displace the intensifier and pressurize fuel for injection into the combustion chamber of the engine.

Both the top surface of the distal end portion 62 of coupling component 50 and a portion of the bottom surface of the proximal end portion 64 of coupling component 50 receive pressure forces from the high pressure actuating fluid. The difference between the areas of the surfaces that receive the pressure forces results in an enhanced clamping force against the fuel injector 12. Further, the enhanced clamping force provides a tighter seal between the coupling component 50 and the fuel injector 12.

Other embodiments of the invention will be apparent to those skilled in the art from consideration of the specification and practice of the invention disclosed herein. For example, clamping assembly 10 may be formed without passages for supplying actuating fluid to fuel injector 12. In such an exemplary embodiment of the invention, either or both of biasing component 48 and coupling component 50 may be formed as a solid component, without an inner passage. Even further, injector biasing assembly 46 may alternatively extend from an opening formed in a component located above fuel injector 12 other than brake housing 20. Such a component could include, for example, a high pressure actuating fluid rail located above the fuel injector. Finally, any type of actuating fluid may be used with this invention, for example, oil or fuel may comprise the actuating fluid.

It is intended that the specification and examples be considered as exemplary only, with a true scope of the invention being indicated by the following claims.

What is claimed is:

1. A clamping assembly for clamping a fuel injector into a fuel injector bore located in cylinder head of an engine, comprising:

a housing having a housing opening;

connectors coupling the housing to the cylinder head;

a compression spring located in the housing opening, operably coupled to a top of the fuel injector, and axially aligned with a longitudinal axis of the fuel injector; and a retaining component located between the top of the fuel injector and the compression spring, the retaining component configured to retain the compression spring within the housing opening independent of the fuel injector.

2. The clamping assembly of claim 1, wherein the compression spring includes a plurality of stacked washers.

3. The clamping assembly of claim 2, wherein the plurality of stacked washers include one of belleville washers, wave washers, finger spring washers, and curved spring washers.

4. The clamping assembly of claim 1, further including a coupling component extending between the compression spring and the fuel injector, the coupling component at least partially located in the housing opening.

5. The clamping assembly of claim 4, wherein the housing includes at least one housing passage connected to a source of injector actuating fluid, and the compression spring and coupling component each include a passage fluidly connecting the at least one housing passage to an actuating fluid inlet of the fuel injector.

6. The clamping assembly of claim 5, wherein the retaining component is located within a gap formed between the housing opening and the coupling component.

7. The clamping assembly of claim 6, wherein the retaining component includes one of a clip ring and an O-ring.

8. The clamping assembly of claim 1, wherein the housing includes a compression release brake housing located substantially above the fuel injector relative to the longitudinal axis of the fuel injector.

9. A method for clamping a fuel injector in a fuel injector bore located in a cylinder head of an engine, comprising:

coupling a housing to the cylinder head at least partially above the fuel injector;

operably coupling a compression spring to a top of the fuel injector, the compression spring located between the housing and the top of the fuel injector; and retainably coupling the compression spring to the housing independent of the fuel injector.

10. The method according to claim 9, wherein the compression spring includes a plurality of stacked washers.

11. The method according to claim 9, wherein the compression spring is located within a housing opening in the housing, and a coupling component is at least partially located in the housing opening between the compression spring and the fuel injector.

12. The method according to claim 11, wherein the housing includes at least one housing passage connected to a source of injector actuating fluid, and the compression spring and coupling component each include a passage fluidly connecting the at least one housing passage to an actuating fluid inlet of the fuel injector.

13. The method according to claim 12, further including providing a retaining component located within a gap formed between the housing opening and the coupling component to assist in said retainably coupling the compression spring to the housing.

14. The method according to claim 13, wherein the retaining component includes one of a clip ring and an O-ring.

15. The method according to claim 13, wherein the housing includes a compression release brake housing located substantially above the fuel injector relative to a longitudinal axis of the fuel injector.

16. An engine system comprising:

a hydraulically-actuated, electronically-controlled fuel injector located in an opening in a cylinder head of the engine;

a fuel injector clamping assembly including a compression release brake housing located above the fuel injector and an injector biasing assembly at least partially located within a housing opening formed in the compression release brake housing, the biasing assembly including a biasing component, a coupling component and a retaining component, the biasing component including a compression spring located in the housing opening and having an inner axial passage extending therethrough, the coupling component located at least partially within the housing opening, extending between the compression spring and the fuel injector, and including an inner axial passage extending therethrough, and the retaining component located adjacent the coupling component in a gap formed between the housing opening and the coupling component, and configured to maintain a substantially fixed relationship between the housing and the compression spring independent of the fuel injector; and an actuating fluid supply connected to the fuel injector including at least one passage in the compression brake housing connected to a source of actuating fluid, the inner axial passage of the compression spring, and the inner axial passage of the coupling component.

17. The engine according to claim 16, wherein the compression spring includes a plurality of stacked washers.

18. The engine according to claim 17, wherein the retaining component includes one of a clip ring and an O-ring.

* * * * *